United States Patent [19]

Traub

[11] Patent Number: 4,495,788

[45] Date of Patent: Jan. 29, 1985

[54] MULTIPLE CURVATURE BENDER

[75] Inventor: Zeno P. Traub, Vista, Calif.

[73] Assignee: Eaton-Leonard Corporation, Carlsbad, Calif.

[21] Appl. No.: 404,531

[22] Filed: Aug. 2, 1982

[51] Int. Cl.[3] ..... B21D 7/04

[52] U.S. Cl. ..... 72/157; 72/159

[58] Field of Search ..... 72/154, 155, 157, 158, 72/159, 217, 218, 219, 319, 320, 321

[56] References Cited

U.S. PATENT DOCUMENTS

| | | | |
|---|---|---|---|
| 3,147,792 | 9/1964 | Hautau | 72/157 |
| 3,155,139 | 11/1964 | Hautau | 72/150 |
| 3,261,193 | 7/1966 | Van Harten | 72/158 X |
| 3,287,952 | 11/1966 | Van Harten | 72/150 |
| 3,299,681 | 1/1967 | Hautau | 72/7 |
| 3,564,892 | 2/1971 | Osterland | 72/219 |
| 4,009,601 | 3/1977 | Shimizu | 72/150 X |
| 4,038,853 | 8/1977 | Schwarze | 72/157 |
| 4,126,030 | 11/1978 | Zollweg et al. | 72/154 |
| 4,137,743 | 2/1979 | Schwarze | 72/150 |
| 4,236,398 | 12/1980 | Schwarze | 72/157 |
| 4,249,407 | 2/1981 | Fogleman | 72/217 |

FOREIGN PATENT DOCUMENTS

| | | | |
|---|---|---|---|
| B 025279 | 1/1956 | Fed. Rep. of Germany | 72/157 |
| 2101162 | 7/1972 | Fed. Rep. of Germany | 72/157 |
| 2910174 | 9/1980 | Fed. Rep. of Germany . | |

*Primary Examiner*—E. Michael Combs

*Attorney, Agent, or Firm*—Gausewitz, Carr, Rothenberg & Edwards

[57] ABSTRACT

A rotary draw bending machine employs a stack of bending dies 22 of different curvatures, forming part of a bend head 18 that is entirely mounted on the forward end of the machine bed 10 for bi-directional lateral and vertical motion so that without changing the position of the centerline of the pipe 16 to be bent, it may be formed by bend dies of different curvature. The entire bend head 18 is shiftable laterally to enable the bend dies to clear the pipe 16 as the dies move vertically to position another die. A single pressure die 20, which is mounted on the movable bend head 18, is mounted for vertical movement relative to the bend head so that it can be positioned in alignment with the pipe.

12 Claims, 9 Drawing Figures

FIG. 3.
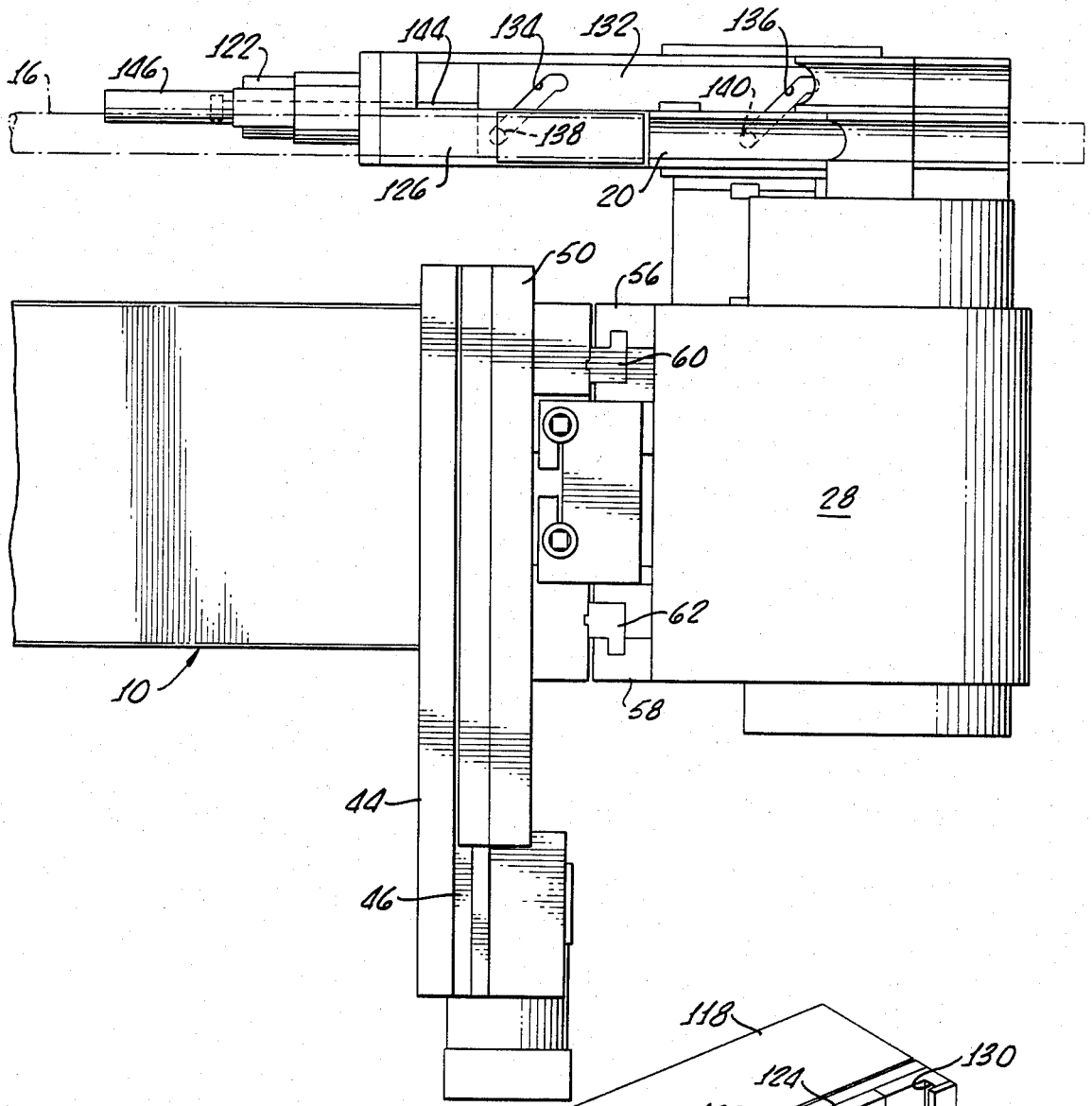
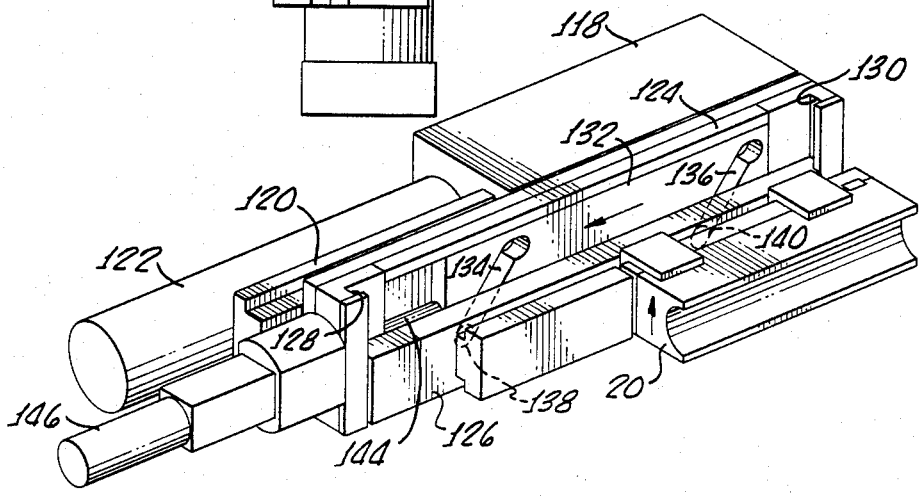
FIG. 7.

FIG. 4.
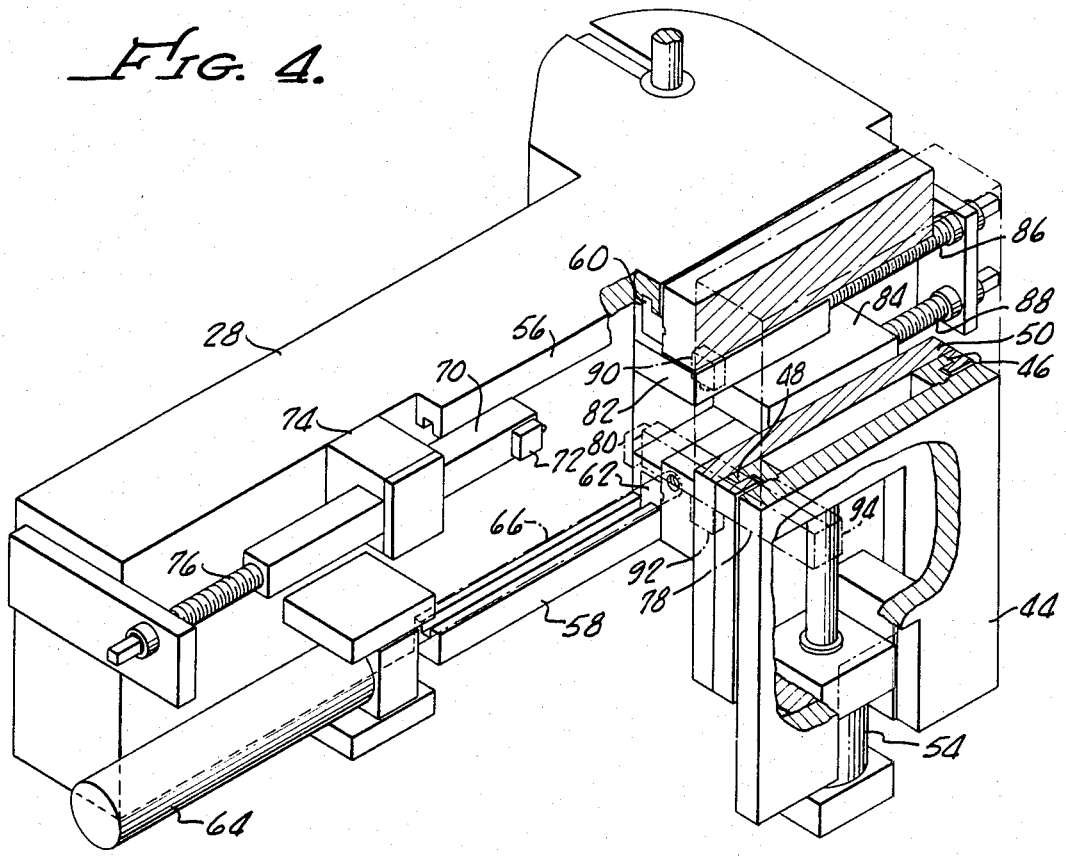
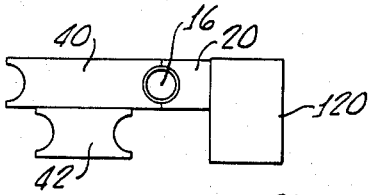
FIG. 8a.
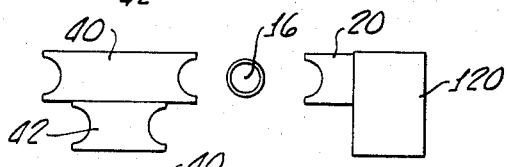
FIG. 8b.
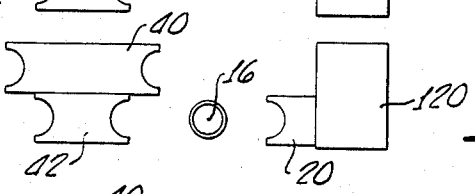
FIG. 8c.
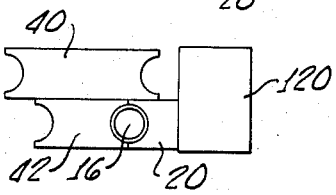
FIG. 8d.

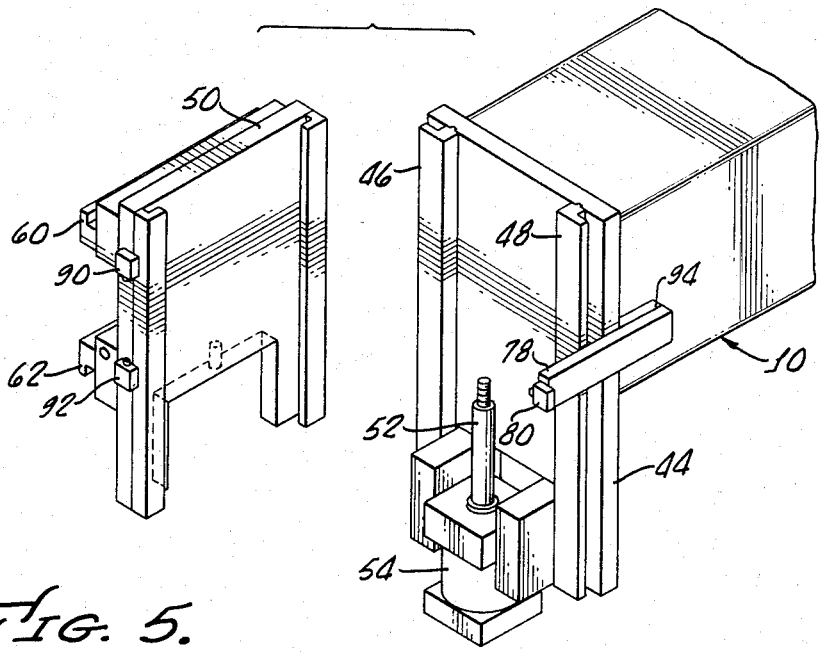
FIG. 5.
FIG. 6.
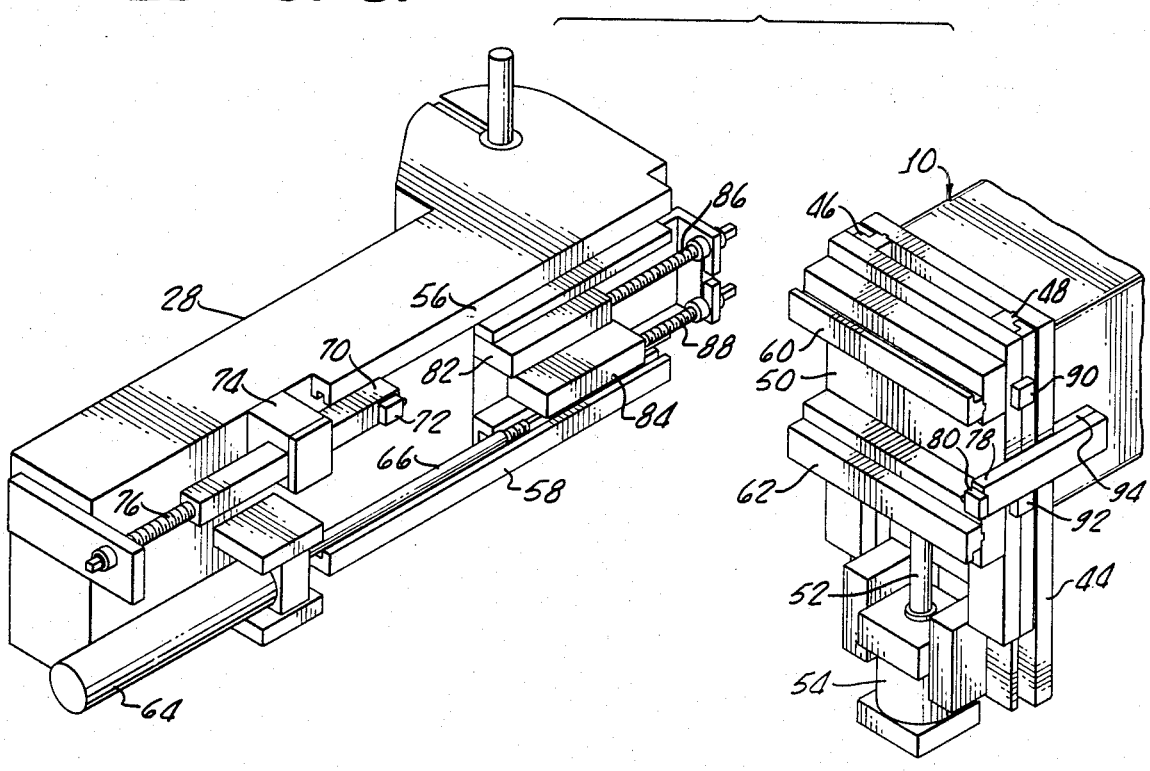

MULTIPLE CURVATURE BENDER

BACKGROUND OF THE INVENTION

The present invention relates to bending machines, and more particularly concerns automatic machines capable of forming successive bends with different bend dies.

Automatic bending machines such as the machines shown in U.S. Pat. Nos. 3,974,676 and 4,063,441 to Homer Eaton and assigned to Eaton-Leonard Corp., the assignee of the present application, perform a series of program-controlled bends upon a given length of pipe by successively positioning different portions of the pipe adjacent the machine bend head, rotating the bend and clamp dies to form a given bend, releasing the pipe from the bend and clamp dies, advancing and rotating the pipe to the next bend position, and again bending, releasing and advancing until all bends of a series have been completed. In the course of rotation of bend and clamp dies to make a bend, a rearward portion of the pipe is restrained by a pressure die which presses the pipe against a backup member or against the bend die and may exert such a frictional restraint upon the pipe as to effect a draw bending, that is, a stretching of the pipe beyond its yield point as the bend and clamp dies are rotated to pull the pipe forwardly.

The radius of bend made with such a machine is determined by the radius of the tooling or, more specifically, the radius of the bend die. If one bend must be very close to or tangent to another, the bend and clamp dies must be formed with cavities having a compound curvature specific to a given pair of adjacent bends. Therefore, if a bend of a radius different than that of the radius of the bend die then mounted on the machine is desired, or if a different pair of tangent bends is desired, the bending must be stopped and the tooling replaced to position a bend die of different bend form.

Multiple radius and compound curvature bend dies have been employed on manually controlled machines, requiring relatively slow step-by-step procedures for adjustment of the machine and for shifting of the tooling. Separate or individual adjustment of different components of the tooling in prior devices introduce serious problems in maintenance of relative alignment and relative positioning of the various dies and machine parts. Such relative positioning may be critical in performing certain kinds of bends, as for example where the position and pressure exerted by a pressure die controls the amount of pipe stretch in a draw bending operation.

Accordingly, it is an object of the present invention to provide a bending machine capable of performing bends of different curvature without tooling change, while avoiding or minimizing the above-mentioned problems.

SUMMARY OF THE INVENTION

In carrying out principles of the present invention, in accordance with a preferred embodiment thereof, bends of different curvature are made by a machine having multiple bend dies mounted on a bending head which is movable in its entirely relative to the machine centerline or pipe axis. The entire bend head assembly is mounted upon the machine bed for bi-directional motion in each of two different directions, both of which are transverse to the machine and pipe axis. A slide block is mounted to the front end of the machine bed for motion in one transverse direction and a stationary bend arm assembly is mounted to the slide block for motion in the other transverse direction to allow a stack of bend dies to be shifted laterally of the bend axis, so as to clear a pipe being bent, and then to be shifted parallel to the bend axis to position a different bend die adjacent the pipe. According to a feature of the invention, precision control of pressure exerted by the pressure die is achieved by use of a single pressure die, driven by precisely controlled hydraulic pressure, and moved relative to the stationary bend arm upon which it is carried to retain alignment with the machine centerline.

BRIEF DESCRIPTION OF THE DRAWINGS

FIG. 3 is a fragmentary elevational view of the mounting of the bend head upon the machine bed;

FIG. 4 is a perspective view with parts broken away, showing the slidable mounting of the stationary arm assembly upon the machine bed;

FIG. 5 is an exploded view, with the slide plate turned ninety degrees, showing bend head mounting structure;

FIG. 6 is an exploded perspective view with the stationary arm turned ninety degrees, showing mounting of the stationary arm to the slide plate;

FIG. 7 is a perspective view of the pressure die and its mounting;

FIG. 8 illustrates the various positions of the dies carried by the bend head as the bend head moves relative to the machine centerline.

DETAILED DESCRIPTION

Figure 1:
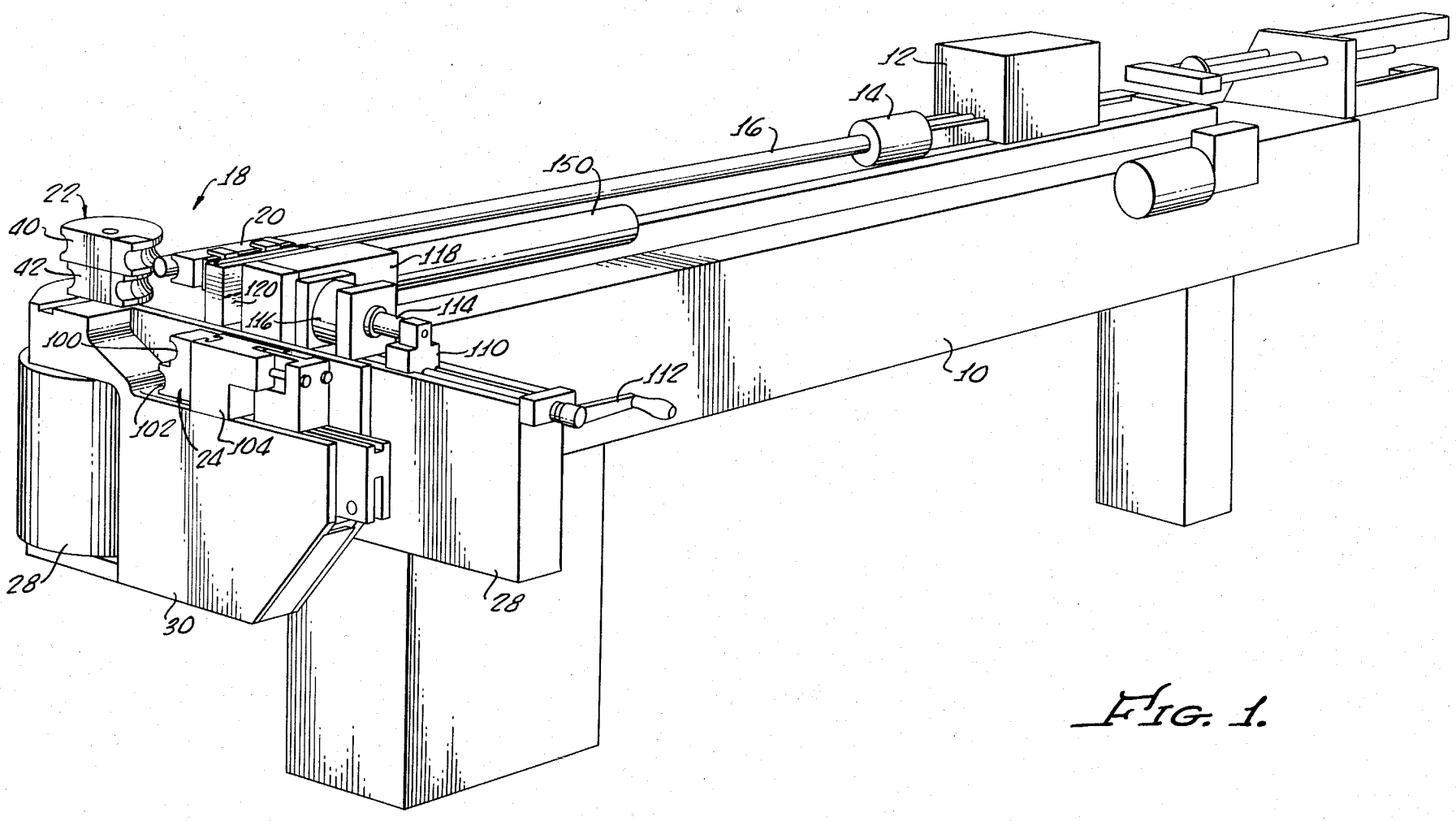
FIG. 1 is a perspective view of bending apparatus embodying principles of the present invention.
Figure 2:
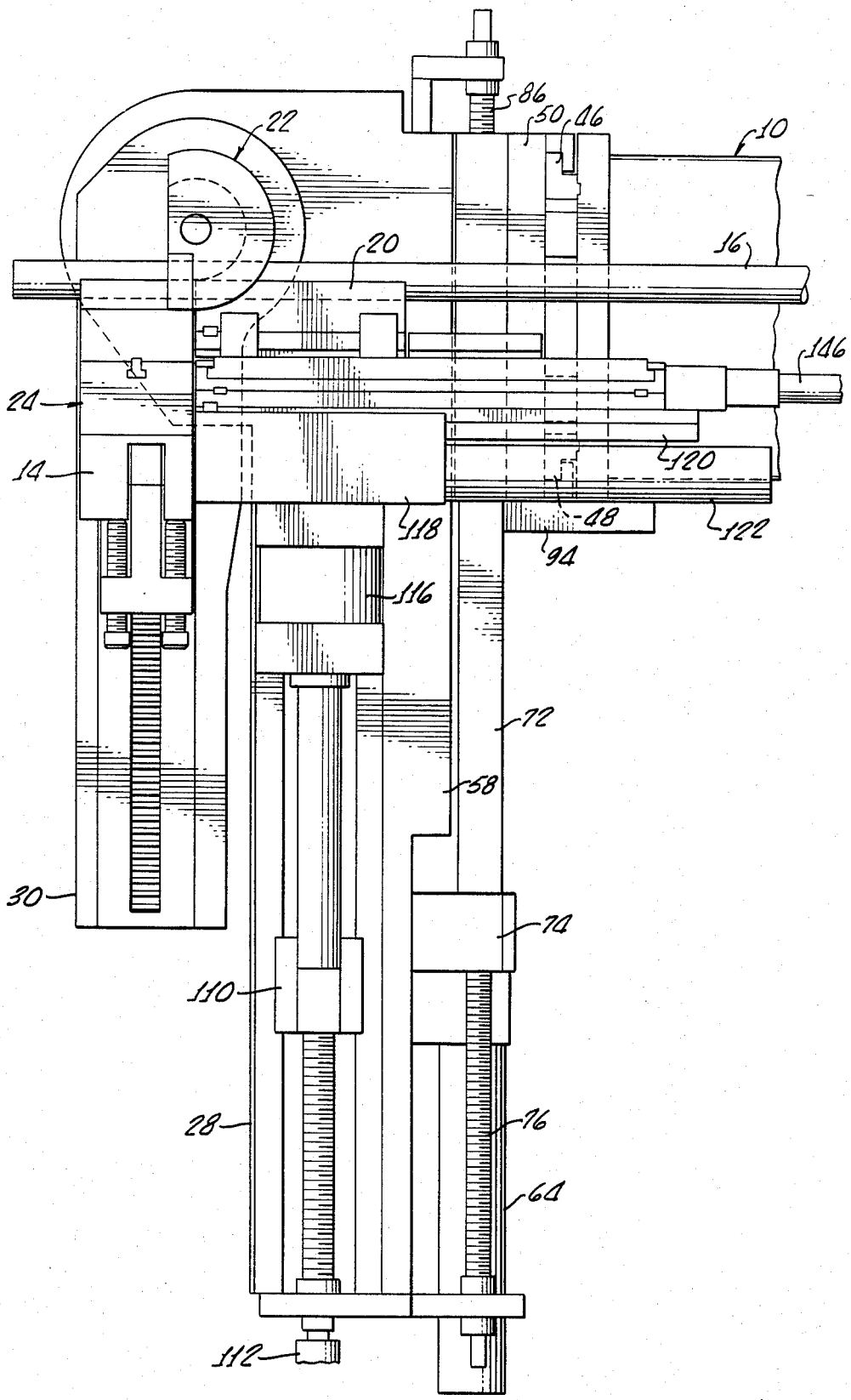
FIG. 2 is a fragmentary plan view of the forward end of the machine bed and the bend head mounted thereon.

The bending machine illustrated in FIG. 1 is of the type shown and described in U.S. Pat. No. 4,063,441. It may be substantially identical therewith except for the movable mounting of the bend head and the changes in the several dies to permit multiple form bending. Although the present invention is disclosed as incorporated in a machine of the type illustrated in FIG. 1, it will be readily appreciated that principles of the invention may be readily applied to other rotary draw bending machines and other rotary bending machines of various configurations. Briefly, the illustrated machine comprises a fixedly supported elongated machine bed 10, having a moving carriage assembly 12 that carries a rotatable chuck 14. The latter grips a pipe 16 which is to be advanced and rotated for preselected positioning with respect to dies carried by a machine bending head generally indicated at 18. The machine includes a pressure die 20, a stack of rotatable bend dies 22, and a stack of shiftable clamp dies 24, rotatable together with the bend die.

For a bending operation, the carriage advances the pipe 16 and the chuck rotates the pipe for positioning with respect to the dies. In this type of machine the pressure die 20 may press the rearward portion of the pipe 16 against the bend die, or against another backup member or wiper die (not shown). The clamp and bend dies cooperate to clamp a forward portion of the pipe and are rotated together about a substantially vertical axis in the illustrated arrangement. This bends the pipe about the bend die. Thereafter, the dies are retracted, the carriage is advanced, and the chuck is rotated to properly position the pipe both longitudinally and rotatably for the next bend.

The bend head assembly includes a stationary arm assembly 28 in which is mounted the drive mechanism for rotating the bend die, as more particularly disclosed in U.S. Pat. Nos. 3,974,676 and 4,063,441. Also mounted on the stationary arm is the mechanism for operating the pressure die 20. A swinging bend arm assembly 30 is mounted upon the stationary arm assembly for rotation with the bend dies 22 about the axis of the latter and carries the clamp dies and their operating mechanism.

The machine preferably is fully automatically controlled to perform a series of bends on a given pipe. Machines of this type, having but a single bend die, are manufactured and sold by Eaton-Leonard Corp. as VECTOR-BEND bending machines.

According to the present invention, the bend die 22 is formed of a stack of coaxial bend dies of mutually different curvature. Various curvature differences may be employed, including different radii of curvature and various compound curvatures. FIG. 1 shows a relatively large radius bend die 40, and a relatively small radius bend die 42 immediately below and coaxial with the larger die. Uniquely, in this machine, in order to present one or the other of the bend dies 40, 42 to the pipe 16, the entire bend head assembly is mounted on the nose (the forwardmost end) of machine bed 10 for bi-directional motion, vertically and horizonally, both directions being mutually perpendicular and perpendicular to the machine axis, which may be considered to lie along the axis of the pipe 16 that is being bent. By moving the entire bending head as a unit, rather than just moving individual tooling elements, the relations of the several tooling elements with respect to one another are maintained and the entire set of tooling, as a unit, is caused to move relative to the machine's centerline for positioning one or the other of the bend dies.

The entire bend head assembly is carried upon the nose of the machine bed 10 with the requisite mobility by a mounting plate 44 (FIGS. 4, 5 and 6) having horizontally spaced, vertically extending guide flanges 46, 48. Plate 44 is fixed as by bolting or welding to the machine bed nose. Slidably mounted in the guides 46, 48 is a vertical slide block 50 that is driven by the piston rod 52 of a drive cylinder 54, fixed to the machine bed.

Elongated stationary bend arm 28 is formed with a pair of vertically spaced, horizontally extending, slotted guide channels 56, 58 that receive mutually vertically spaced horizontally extending guide tongues 60, 62, fixed to and spaced forwardly of the forward side of the vertical slide block 50. The stationary arm assembly is driven horizontally, transversely of the machine axis, by means of an hydraulic cylinder 64 fixed to the stationary arm and having a driven piston rod 66 connected to a side of vertical slide block 50.

The extreme or limit position of the stationary arm assembly 28, as it moves horizontally outwardly of the machine axis (toward the right as viewed in FIG. 4) is controlled by contact with a side of the vertical slide block by a sliding stop bar 70 carrying a limit switch 72 and mounted in a stop block 74 fixed to the stationary arm assembly. Switch 72 provides a signal indicating that the limit position has been reached. Position of bar 72 is manually adjusted by a shaft 76 journalled in the stationary arm assembly and threadedly engaged in the slide bar 70.

To control limits of the horizontally inward motion (towards the left as viewed in FIG. 4) of the bending head, there is provided on the fixed structure 44, a physical stop 78 having an electrical switch 80, positioned to be contacted by first and second inward motion stop blocks 82, 84, respectively, which are mounted to the stationary arm assembly on adjustable threaded rods 86, 88, respectively.

The limit position controlled by abutment of block 84 with stop 78 and signaled by operation of switch 80 (in the position for use of the smaller radius bend die) is intermediate the outermost position controlled by stop 70 and the innermost position controlled by block 82 and signaled by switch 80 (in the operative position of the bend head for use of the larger radius bend die 42).

Upper and lower limit positions of the bend head in the course of its vertical motion are signaled by limit switches 90, 92 which are operated by opposite sides of stop 78 which is fixed to the mounting plate 44 and to bed 10 by a plate 94. Limit switches 90, 92 are carried by the vertical slide block 50.

Dual curvature clamp die 24 includes a first die cavity 100 for cooperation with the large radius bend die 40 and a second die cavity 102 for cooperation with the smaller bend die 42. The clamp die with its dual curvature cavities is carried by a clamp die bolster 104 which is mounted on a linkage arrangement, as more particularly disclosed in U.S. Pat. No. 4,063,441, for movement from the retracted position illustrated in FIG. 1 to an operative position wherein the two bend die cavities adjoin and mate with the two clamp dies cavities to clamp the pipe 16 between the upper or lower pair, depending upon the vertical position of the bend head.

Stationary bend arm 28 carries an adjusting plate 110 that is slidably adjustable by means of a handle 112 and is connected to an end of a piston rod 114 of an hydraulic cylinder 116 that is mounted upon a pressure die bolster 118. As best seen in FIGS. 3 and 7, a pressure die slide 120 is mounted to the bolster 118 for slidable motion longitudinally of the machine axis and driven by the piston rod (not shown) of an hydraulic cylinder 122 so that the slide 120 (together with the pressure die carried thereby) can be driven forwardly. Fixedly mounted to the inner surface of pressure slide 120 is a cam plate guide 124 in which a pressure die carrier 126 is mounted for limited vertical motion, having its ends captured and slidably guided in forward and rearward guide slots 128, 130 of the cam plate guide 124. Pressure die 20, which has but a single die cavity, is mounted upon carrier 126. Slidably mounted for motion longitudinally of the machine axis, within the cam plate guide 124 and located between an outer portion of the guide and pressure die carrier 126, is a cam plate 132. Formed in the cam plate is a pair of mutually spaced, vertically inclined cam slots 134, 136, which receive cam pins 138, 140. The cam pins are fixed to pressure die carrier 126 and extend into camming engagement with the slots. Cam plate 132 is driven in a direction parallel to the machine axis by means of a piston rod 144 driven by an hydraulic cylinder 146 that is fixedly mounted to cam plate guide 124.

Assume the parts initially are in a position as schematically illustrated in FIG. 8(*a*), with the entire bend head in a lower position so that the larger radius bend die 40 is in position to engage the pipe 16 and the pressure die 20 is in an upper position with respect to pressure die slide 120. After a bend in the position of FIG. 8(*a*) has been completed, and assuming that it is desired to make the next bend with the smaller radius bend die 42, pressure die bolster 120 and the pressure die are retracted, carriage 12 is advanced and chuck 14 rotated to position the pipe for the next bend. Then, or concurrently with motion of the carriage and chuck, the entire bend head, including the stationary arm and swinging arm assembly, together with all the tooling, mounted on the movable bend head, are moved outwardly of the machine axis to the position shown in FIG. 8(*b*), to allow the bend dies to clear the pipe. The pressure die and its bolster are separately and independently slidable laterally with respect to the stationary arm, and this lateral retraction of the pressure die is also illustrated in FIG. 8(*b*). Then, the entire bend head assembly is moved upwardly to the position illustrated in FIG. 8(*c*), so as to position the second and smaller of the two bend dies in alignment with the pipe. Simultaneously, the pressure die 16 is shifted downwardly relative to the bend head so as to bring the pressure die back into alignment with the pipe (FIG. 8(*c*)). Then, the entire bend head is shifted inwardly toward the pipe (toward the right as illustrated in FIG. 8) and the pressure die bolster and pressure die assembly are shifted inwardly toward the pipe to operative bend position. In these operations, of course, the clamp dies which are mounted on the swinging bend arm will move laterally outwardly and inwardly and vertically, together with the swinging bend arm, and will be shifted between clamped and retracted position at an appropriate point in the sequence. Of course, a number of the steps in the positioning sequence may be carried out concurrently with one another in order to decrease the time required for a bending cycle. To reposition the larger of the bend dies for operation, the reverse sequence of operations is carried out.

It may be noted that instead of using a clamp die having two separate cavities for cooperation respectively with the first and second bend dies, a single clamp die could be employed, mounted for motion in a manner analogous to the vertical motion of the pressure die (to be described below) so as to bring such single cavity clamp die back into alignment with the pipe upon vertical displacement of the bending head. Similarly, instead of using a clamp die mounted for vertical motion on the shiftable bend head and having a single die cavity, a pair of pressure dies, or a single pressure die having a pair of pressure die cavities, could be employed in a manner analogous to the dual cavity clamp dies. However, the use of a single cavity pressure die, with the die being shiftable relative to the shiftable bend head itself, has a significant advantage. In many types of bending operations, the pressure die, when moved to its operative position, will not only press the pipe against the bend die, but will actually itself be in direct contact with a flange of the bend die. To avoid sliding frictional motion of the contacting bend and pressure dies, the pressure die may be driven forwardly at a linear rate equal to or nearly equal to the rate of linear motion of the contacting peripheral portion of the bend die. However, the rate of linear motion of the bend die periphery depends upon the bend die diameter for a given rate of angular rotation. The use of plural cavity pressure dies, both contacting bend dies of mutually different diameters, may result in an undesirable relative frictional sliding contact between pressure and bend dies that cannot be avoided. Accordingly, a single cavity pressure die mounted for vertical motion relative to the bend head, is preferred.

Figure 9:
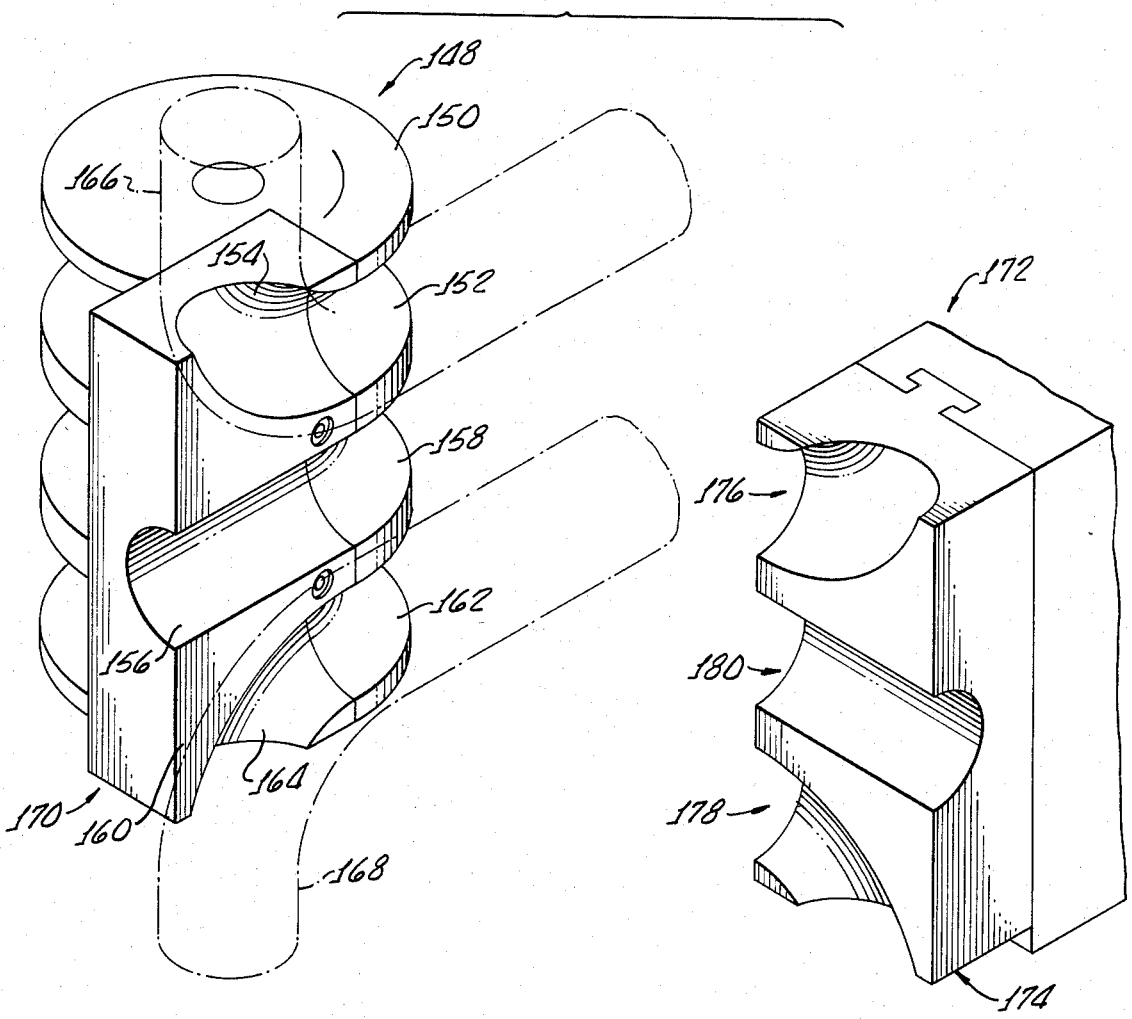
FIG. 9 is a perspective view of a set of triple form bend and clamp dies, with the clamp dies shifted through ninety degrees to show their compound curvature die cavities.

Illustrated in FIG. 9 is a set of multiple bend and clamp dies having three different bending forms. A stack of bend dies includes a first bend die section 150 having a compound curvature cavity with a first curvature portion 152 and a second curvature portion 154, a second or intermediate bend die section having a straight portion 156 followed by a single curvature cavity portion 158, and a third and lowermost bend die section 160 having a compound curvature cavity with a first curvature portion 162 and a second curvature portion 164. Die cavity portions 152, 156, 158 and 162 are formed on axes parallel to the pipe axis, whereas die cavity portions 154 and 164 extend outwardly (upwardly and downwardly, respectively) of the bend die stack. The compound curvature cavities are employed where two bends are to be made that are tangent to one another. Thus, after bending a first portion of the pipe, as shown in dotted lines 166 of FIG. 9, the pipe is positioned in the bend die section 150 to form the next bend by the first portion 152 of the cavity. The bend being made by cavity portion 152 is so close to the previous bend that the previously bent portion of the pipe must be seated within the second cavity portion 154 which extends outwardly of the bend die (upwardly, as illustrated in FIG. 9). Similarly, to enable a first bend to be made so that a bent portion 168 of the pipe will extend downwardly when the pipe is to be bent in first cavity portion 162 of the third bend die section 160, the die cavity portion 164 extends downwardly and outwardly of the bend die to allow the previously bent portion of the pipe to be properly clamped against the bend die. The intermediate bend die cavity is used where the bend to be made by cavity portion 158 is spaced from a prior bend by a straight pipe portion long enough to accept a clamp die. Preferably, the bend die cavities are formed in a solid integral insert 170 that is rigidly but detachably secured to the bend form 148.

The clamp die 172 that cooperates with the triple bend form bend die 148, is similarly made with an insert 174 that is rigidly but detachably mounted to the bend die 172. Insert 174 is formed with compound curvature cavities 176 and 178 which mate respectively with compound curvature cavities 152, 154 and with compound curvature cavities 162, 164. Interposed between clamp die sections 176, 178 is a third single curvature clamp die section having a straight cavity 180 that mates with the single curvature cavity 158 of the intermediate bend die section.

The various steps of the machine may be carried out under manual control if deemed necessary or desirable. However, for optimum operation, all motions and operations of the machine are carried out under control of a program in the automatically controlled machine. The machine is programmed for operation just as it has been in the past for making bends with a single bend die, except for the addition of the program steps needed to shift the bend head and pressure die horizontally and vertically as previously described. With such automatic programming, a series of bends of different single or compound curvatures can be readily made by automatic operation on a single piece of pipe without stopping the machine operation for change of tooling.

The foregoing description is to be understood clearly as given by way of illustration and example only, the spirit and scope of this invention being limited solely by the appended claims.

I claim:

1. Bending apparatus comprising an elongated machine bed, a carriage mounted for motion on the machine bed in a direction toward and away from a forward end of said bed, a pipe holding chuck mounted on the carriage for holding a pipe with its axis aligned in said direction, a bending head carried by the forward end of said machine bed and including first and second bend dies for bending a pipe about a bend axis, means for mounting said bending head on said machine bed for reciprocal motion in a second direction parallel to said bend axis and in a third direction transverse to said bend axis and to said first direction, and said bending head comprising a stationary arm assembly, and said means for mounting said bending head comprising a slide block slidably mounted on a forward end of said machine bed for motion in one of said second and third directions, means for mounting said stationary arm assembly to said slide block for slidable motion in the other of said second and third directions, a swinging bend arm assembly mounted on said stationary arm assembly for rotation about said bend axis, said bend dies being mounted on said swinging bend arm assembly, whereby the bend dies move together with both said stationary and swinging bend arm assemblies in said second and third directions, and clamp die means carried by said swinging bend arm assembly for motion toward and away from said bend dies.

2. The apparatus of claim 1 wherein said bend dies include first and second bend dies of mutually different bending form, and wherein said clamp die means include a clamp die bolster movable between a retracted position and a clamping position, and first and second clamp dies mounted on said bolster for cooperating respectively with said first and second bend dies to clamp a pipe therebetween when said clamp die bolster is in said clamping position.

3. The apparatus of claim 1, including a pressure die for restraining a rearward portion of a pipe being bent by said bend and clamp die means, and means for movably mounting said pressure die on said stationary arm assembly for reciprocal motion in a direction parallel to said bend axis whereby when said stationary arm assembly is moved in said second direction to position one or the other of said bend dies adjacent the pipe to be bent, said pressure die can be moved in an opposite direction to return to a position in alignment with the pipe to be bent.

4. The apparatus of claim 3, wherein said means for mounting said pressure die comprises a pressure die bolster slidably mounted on said stationary arm assembly, means for driving said pressure die bolster along said stationary arm assembly toward and away from said bend dies, said pressure die being mounted to said bolster for motion in a direction parallel to said bend axis, a pressure die cam carried by said bolster, means for driving said cam relative to said bolster, and a cam follower fixed to said pressure die and cooperating with said cam for moving said pressure die in a direction parallel to said bend axis in response to driving of said cam.

5. The bending apparatus of claim 3, including a pressure die bolster movably mounted on said stationary arm assembly for motion toward and away from said bend dies, a pressure die mounted to said bolster for bi-directional motion in a direction parallel to said bend axis, and interengaging cam means on said pressure die and bolster for moving said pressure die relative to said bolster in a direction parallel to said bend axis.

6. Bending apparatus comprising an elongated machine bed, a carriage mounted for motion on the machine bed toward and away from a forward end of the bed, a pipe holding chuck mounted on the carriage, said carriage being mounted for motion in a first direction parallel to the longitudinal extent of a pipe held in said chuck, and a bending head mounted on a forward end of said machine bed for bi-directional motion in each of second and third directions that are each transverse to one another and to said first direction, said bending head comprising a slide block slidably mounted to a forward portion of said machine bed for bi-directional motion in one of said second and third directions, a stationary arm assembly slidably mounted to said slide block for bi-directional motion in the other of said second and third directions, a swinging bend arm assembly mounted to said stationary arm assembly for rotation about a bend axis extending in one of said second and third directions, first and second bend dies of mutually different form mounted on said swinging bend arm assembly for rotation therewith, clamp die means mounted on said swinging bend arm assembly for cooperating with said bend dies to clamp a pipe, and pressure die means carried on said stationary arm assembly for restraining a pipe being bent around said bend dies.

7. The apparatus of claim 6 wherein said clamp die means comprises a clamp die bolster, first and second clamp dies fixed to said bolster for cooperation respectively with said first and second bend dies, means for mounting said bolster and the clamp dies carried thereby on said swinging bend arm assembly for unitary motion between a retracted position in which the clamp dies are displaced from the bend dies, and a clamp position in which each of said first and second clamp dies is in clamping position with respect to a respective one of said first and second bend dies for clamping a pipe therebetween, and means for driving said clamp die bolster and clamp dies between said positions.

8. The apparatus of claim 6 wherein said pressure die means comprises a pressure die bolster mounted on said stationary arm assembly for motion toward and away from said bend dies, a pressure die mounted on said bolster for bi-directional motion in a direction parallel to said bend axis, and means for shifting said pressure die in a direction parallel to said bend axis, whereby said pressure die can be shifted relative to said stationary arm assembly to align with a pipe held in said chuck when said stationary arm assembly is moved relative to said machine bed.

9. The apparatus of claim 6 wherein said pressure die means comprises a pressure die bolster mounted on said stationary arm assembly for motion toward and away from said bend dies, a pressure die slide mounted on said bolster for bi-directional motion in a direction parallel to said first direction, a pressure die carrier slidably mounted to said pressure die slide for motion in a direction parallel to said bend axis, a pressure die carried by said carrier, a cam plate slidably mounted to said pressure die slide, a cam follower fixed to said pressure die carrier and cooperating with said cam plate to drive said pressure die carrier and pressure die in response to slidable motion of said cam plate, and means for driving said cam plate.

10. The apparatus of claim 6 including a third bend die on said swinging bend arm assembly coaxial with said first and second bend dies, said second bend die being between said first and third bend dies, said first and third bend dies each having a cavity of compound curvature, the cavity of said first bend die having a first portion formed on an axis parallel to said first direction and a second portion extending outwardly therefrom, the cavity of said third bend die having a first portion formed on an axis parallel to said first direction and having a second portion extending outwardly of said bend dies oppositely relative to the second portion of the cavity of said first bend die.

11. The apparatus of claim 6 wherein said bend dies each have a die cavity of mutually different compound curvature.

12. The apparatus of claim 11 including a third bend die interposed between said first and second bend dies and coaxial therewith.

* * * * *